US006651561B2

(12) United States Patent
Koizumi et al.

(10) Patent No.: US 6,651,561 B2
(45) Date of Patent: Nov. 25, 2003

(54) APPARATUS AND METHOD FOR FEEDING PRINTING PLATE PRECURSORS

(75) Inventors: Takashi Koizumi, Kanagawa (JP); Tsukasa Ono, Kanagawa (JP); Kazuhisa Tazaki, Saitama-ken (JP)

(73) Assignees: Fuji Photo Film Co., Ltd., Kanagawa (JP); Fuji Photo Optical Co., Ltd., Saitama-ken (JP)

( * ) Notice: Subject to any disclaimer, the term of this patent is extended or adjusted under 35 U.S.C. 154(b) by 0 days.

(21) Appl. No.: 10/115,100

(22) Filed: Apr. 4, 2002

(65) Prior Publication Data

US 2002/0157554 A1 Oct. 31, 2002

(30) Foreign Application Priority Data

Apr. 25, 2001 (JP) ..... 2001-127342

(51) Int. Cl.[7] ..... B65H 3/08; B65H 3/46

(52) U.S. Cl. ..... 101/477; 101/483; 101/401.1; 271/104

(58) Field of Search ..... 101/477, 479, 101/480, 407.1, 401.1, 463.1, 483, 484, 494; 271/104, 107, 170

(56) References Cited

U.S. PATENT DOCUMENTS

| | | | | |
|---|---|---|---|---|
| 5,041,879 A | * | 8/1991 | Akao et al. | 271/107 |
| 5,290,023 A | * | 3/1994 | Sasaki et al. | 271/20 |
| 2002/0047234 A1 | * | 4/2002 | Ono et al. | 271/90 |
| 2003/0011124 A1 | * | 1/2003 | Leonarde et al. | 271/107 |

* cited by examiner

*Primary Examiner*—Leslie J. Evanisko
(74) *Attorney, Agent, or Firm*—Sughrue Mion, PLLC

(57) ABSTRACT

An apparatus for feeding printing plate precursors is provided with a detecting sensor for detecting a position of a separation plate mounted on a cassette accommodating printing plate precursors, and a plate surface detecting sensor for detecting an uppermost plate of printing plate precursors stacked in the cassette. A relative position of the separation plate with respect to suction nozzles of a suction frame of the apparatus for feeding plates is controlled constant.

20 Claims, 10 Drawing Sheets

APPARATUS AND METHOD FOR FEEDING PRINTING PLATE PRECURSORS

BACKGROUND OF THE INVENTION

1. Field of the Invention

The present invention relates to an apparatus and a method for feeding printing plate precursors, wherein printing plate precursors are accommodated in a stack, and an uppermost printing plate precursor is removed from the stack such that it is kept in a state of substantially parallel to lower plates.

2. Description of the Related Art

A technique has been developed, wherein a printing plate precursor such as a photopolymer plate having a photosensitive layer (for example, a photopolymerization layer) provided on a support is used and an image is directly recorded on the photosensitive layer of the printing plate precursor using a laser beam or the like. There is an automatic exposure apparatus for printing plate precursors.

In such a technique, printing plate precursors have to be transferred one after another in order for image recording on a printing plate precursor to be performed rapidly. For this purpose, a plurality of the printing plate precursors and interleaf papers for protecting the printing surface of the printing plate precursors are accommodated in a cassette in which the plates and the interleaf papers are alternately stacked. The plates and the interleaf papers are kept in this condition at a predetermined position, then the printing plate precursors are automatically removed one-by-one by a suction-adhering apparatus including suction nozzles and fans, and then transferred to the exposure portion.

Further, the cassette in which the printing plate precursors are accommodated is provided with a separation plate, which corresponds with both corners of the upper ends of the accommodated printing plate precursors. When a printing plate precursor is removed from the cassette by the suction-adhering apparatus such as suction nozzles and fans, the separation plate engages with the printing plate precursor and causes the both corners of the upper end of the printing plate precursor to bend. Consequently, the printing plate precursor which is suction-adhered can be separated from the underlying printing plate precursor or the interleaf paper rapidly and removed.

In the prior art, a suction-adhering apparatus including suction nozzles and fans is provided in a feeding apparatus body. While, cassettes are detachable from the feeding apparatus body. A plurality of cassettes each accommodating printing plate precursors of different sizes are provided, and they are selected in accordance with need and mounted in the feeding apparatus body.

For this reason, the structure is such that even when the cassette is changed, the relative position of the suction-adhering apparatus with respect to the cassette basically corresponds in design. However, deviation of the position of the suction-adhering apparatus with respect to each cassette may occur due to differences in the printing apparatus.

Here, after suction nozzles of a suction-adhering apparatus suction-adheres a printing plate precursor, the nozzles must be raised to a position at which a separation plate can separate the plate properly.

This movement starts with the position of the suction-adhering apparatus as an initial position. The suction-adhering apparatus is provided in a unit capable of moving toward and away from the cassette, along with a plate sensor for detecting the uppermost printing plate precursor accommodated in the cassette. Therefore, the position of this unit is determined as the initial position.

The unit approaches the cassette from the initial position. Then, when the uppermost printing plate precursor is detected by the plate detecting sensor, approaching movement of the unit is stopped after movement of a predetermined amount after detection. At this point, the suction nozzles of the suction apparatus adheres to the plate surface, then the printing plate precursor can be suction-adhered by starting suctioning.

After this operation, the unit is moved in a direction away. From the cassette it is moved to a position which has been memorized as the most optimum point for the separating position. When the unit is driven by a pulse motor, the pulse number should be memorized.

However, as described above, when the relative position of the apparatus body with respect to the cassettes does not match, an optimum positioning can not be unconditionally determined.

For this reason, in the vicinity of the optimum separating position, the suction nozzles which suction-adhere a printing plate precursor is moved intermittently so as to secure the optimum position which is different each time.

This problem can be resolved to a certain extent by memorizing the optimum separating position of the suction nozzles as an initial value and using amending data to amend the initial value for each cassette. However, a separate apparatus for discriminating cassettes is needed. Further, if an error occurs in discriminating the cassettes, separating efficiency may decrease. As strict control of the operation is needed, control operation for an operator becomes complicated.

Further, even in the case where the cassettes are the same size the positioning error may be caused due to the member in which the cassette is mounted. In this case, the amending data is not useful.

SUMMARY OF THE INVENTION

The present invention has been devised in view of the above-described circumstances, and an object thereof is to achieve a sheet feeding apparatus for printing plate precursors by which at each feeding the optimum position of a suction-adhering apparatus can be determined and sheet-feeding with efficient separation can be reliably provided.

A first aspect of the present invention is an apparatus for feeding printing plate precursors, the apparatus comprising: a cassette which accommodates printing plate precursors in a stack, the cassette including a separation plate that engages with corners of the printing plate precursors for aiding to separate an uppermost printing plate precursor from underlying printing plate precursors; a suction unit including a suction member which suction-adheres to an uppermost printing plate precursor accommodated in the cassette, the suction unit being supported so as to be movable toward and away from the cassette; a driving device which moves the suction unit; a plate detecting sensor provided in the suction unit, the plate detecting sensor being positioned within a predetermined distance of a printing plate precursor using a suction surface of the suction member as a reference so as to detect a position of the uppermost printing plate precursor when the suction unit moves close to the printing plate precursor; a separating plate detecting sensor provided in the suction unit, the separating plate detecting sensor for detecting the separating plate or a member having a fixed relative position with respect to the separating plate before the plate detecting sensor detects the uppermost printing plate precursor; and a controlling device which controls the driving device on the basis of the detection by the plate detecting sensor and the separation plate detecting sensor to move the suction unit toward and away from the cassette while controlling timing of the suction member for removal of printing plate precursors.

According to the present invention, a suction unit is moved towards cassettes from the predetermined position. During this movement, a position, at which a separation plate is detected by a separation plate detecting sensor, is memorized. Further, a member whose relative position with respect to a separation plate is fixed, may be detected instead of direct detection of the separation plate.

A second aspect of the present invention is A method for feeding printing plate precursors from a cassette holding the printing plate precursors in a stack, the method comprising the steps of: determining the initial position of a movably mounted suction frame which suction adheres printing plate precursors to suction nozzles provided on the suction frame by application of reduced pressure to the suction nozzles; moving the suction frame toward the cassette using a pulse-controlled motor which when operated moves the suction frame away and towards the cassette; detecting a portion of the cassette with a first sensor; detecting a surface of an uppermost printing plate precursor in the stack in the cassette with a second sensor; reading a first drive controlling pulse number of the motor; and moving the suction frame further downward by a predetermined amount and stopping the frame at a position at which the suction nozzles adhere to the uppermost printing plate on the stack when reduced pressure is applied to the suction nozzles.

At this point, the suction unit continues the movement. During this movement, the uppermost printing plate precursor accommodated in the cassette is detected by the plate detecting sensor. Then, a suction-adhering member closely contacts the uppermost printing plate precursor by moving by the predetermined amount.

After a suction-adhering member closely contacts the printing plate precursor, the suction-adhering member is moved apart from a cassette. At this point, the suction-adhering unit is moved to the separation plate detecting position which was memorized previously, then the unit is stopped.

A separation plate detecting point of a separation plate detecting apparatus is defined as an optimum separating point when a suction-adhering member suction adheres to a printing plate precursor. Consequently, the uppermost printing plate precursor is separated from an underlying plate precursor reliably and transferred to the next process.

As described above, an optimum point for separating is determined and an efficient separation is provided by a proper detection of a separation plate detecting apparatus. Even if a cassette is changed, operation for rewriting amending data and the like is not needed.

DESCRIPTION OF THE PREFERRED EMBODIMENTS

Figure 1:
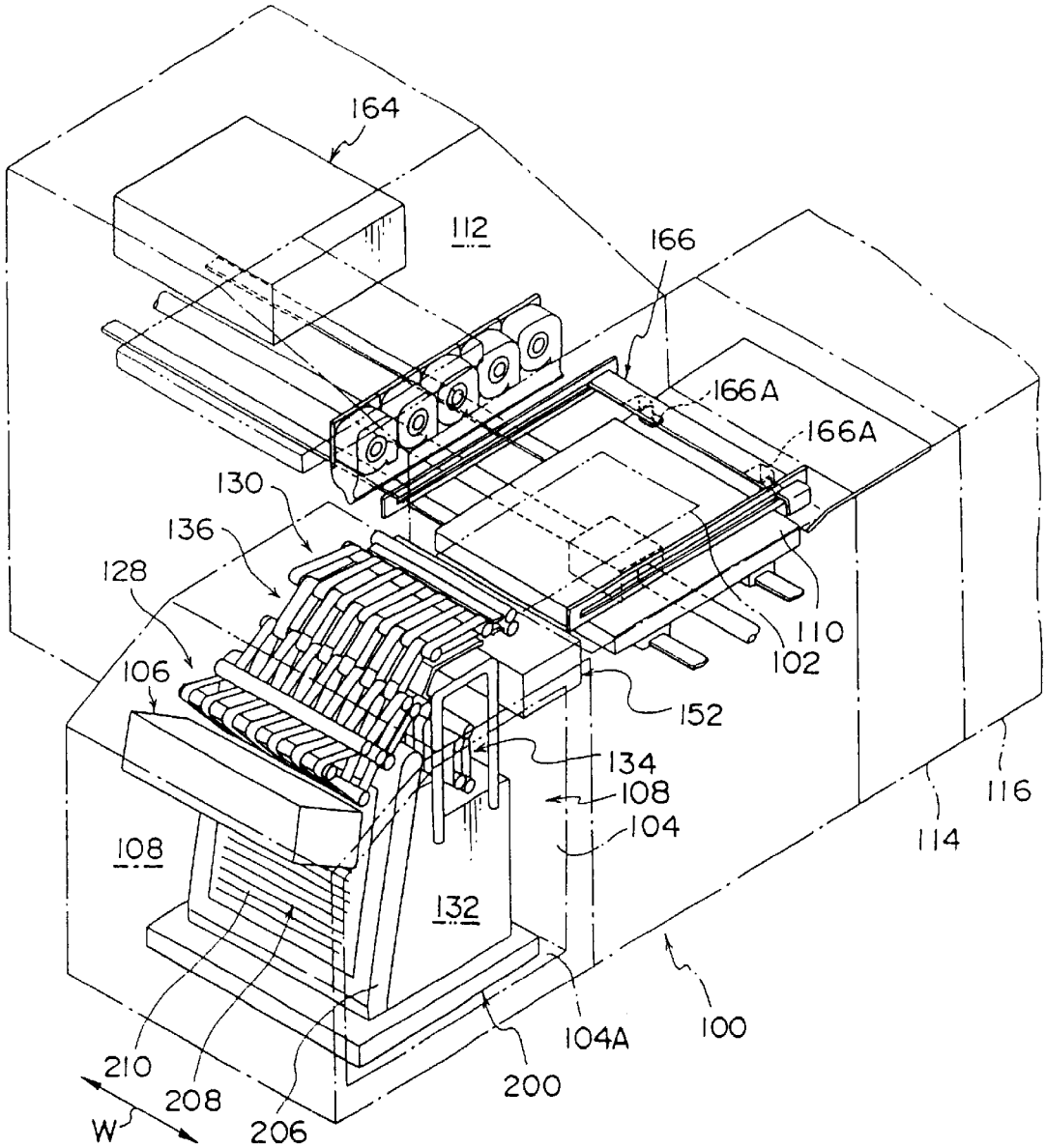
FIG. 1 is a structural diagram which schematically shows an automatic exposure apparatus applied to an embodiment of the present invention.

FIG. 1 shows an automatic exposure apparatus 100 according to an embodiment of the present invention. The automatic exposure apparatus 100 includes a sheet feeding section 106 by which a plate accommodating section 104, in which photopolymer plates 102 (see FIG. 3) placed on a carriage 200 are accommodated, and the photopolymer plates 102 accommodated in the plate accommodating section 104 are removed, a surface table 110 for positioning and holding the photopolymer plates 102, a plate supplying section 108 for transferring the photopolymer plates 102 removed by the sheet feeding section 106 to the surface table 110, and an exposure section 112 in which an image is recorded on a photopolymer plate 102 positioned on the surface table 1110.

An automatic processing apparatus 116 can be provided at a downstream side of the automatic exposure apparatus 100 via a buffer section 114, and supplying of plates, exposure, and processing can all be automatically processed.

Figure 2:
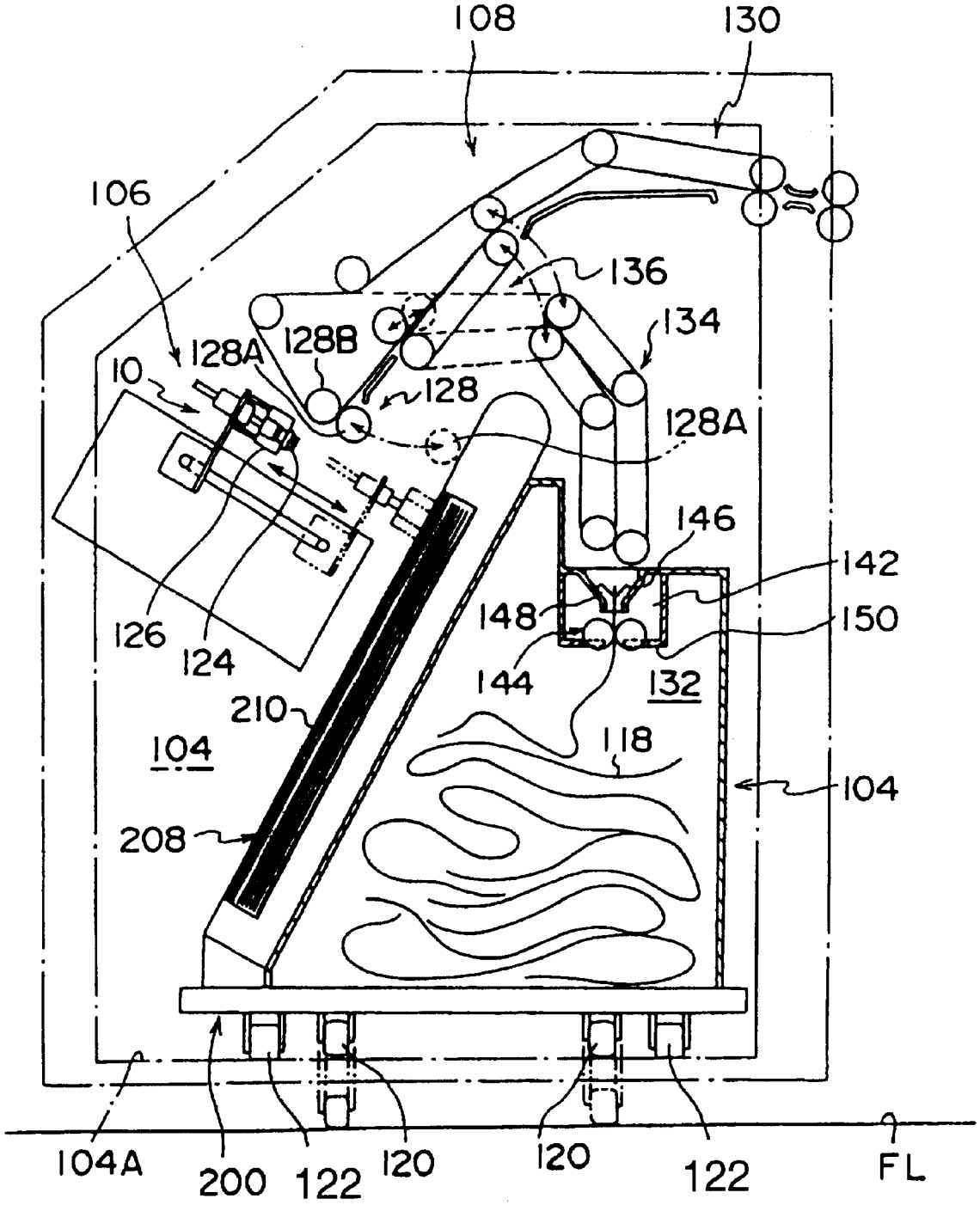
FIG. 2 is a structural diagram which schematically shows the main portion of the automatic exposure apparatus having the sheet feeding section to which the present invention is applied.

As illustrated in FIG. 2, the plate accommodating section 104 includes a floor portion 104A at a position higher than the floor surface FL on which the carriage 200 moves, and the carriage 200 is formed so as to ride on the floor portion 104A above the floor surface FL. The carriage 200 includes casters 120 which can each move to a position at which it projects from the carriage 200 (that is, the position indicated by the phantom lines in FIG. 2) and also to a position at which it is accommodated in the carriage 200 (that is, the position indicated by solid lines in FIG. 2). The carriage 200 can be moved by the casters 120 on the floor surface FL. Further, the carriage 200 is accommodated in the plate accommodating section 104 at a predetermined position in such a manner that the casters 120 are moved to the accommodated position so as to be made retractable toward the upper side corresponding to an operation of accommodating the carriage 200 in the plate accommodating section 104, and the carriage 200 moves by auxiliary rollers 122 on the floor portion 104A.

An accumulating portion 206 is provided in the carriage 200 and a cassette 208 is mounted in the accumulating portion 206 in such a manner as to be inclined at a predetermined angle. A large number of (for example, several tens of) photopolymer plates 102 are accommodated in advance on a bottom plate 212 of the cassette 208 in a stack, and the photopolymer plates 102 are loaded in the plate accommodating section 104 by mounting the carriage 200 in the plate accommodating section 104.

Figure 3:
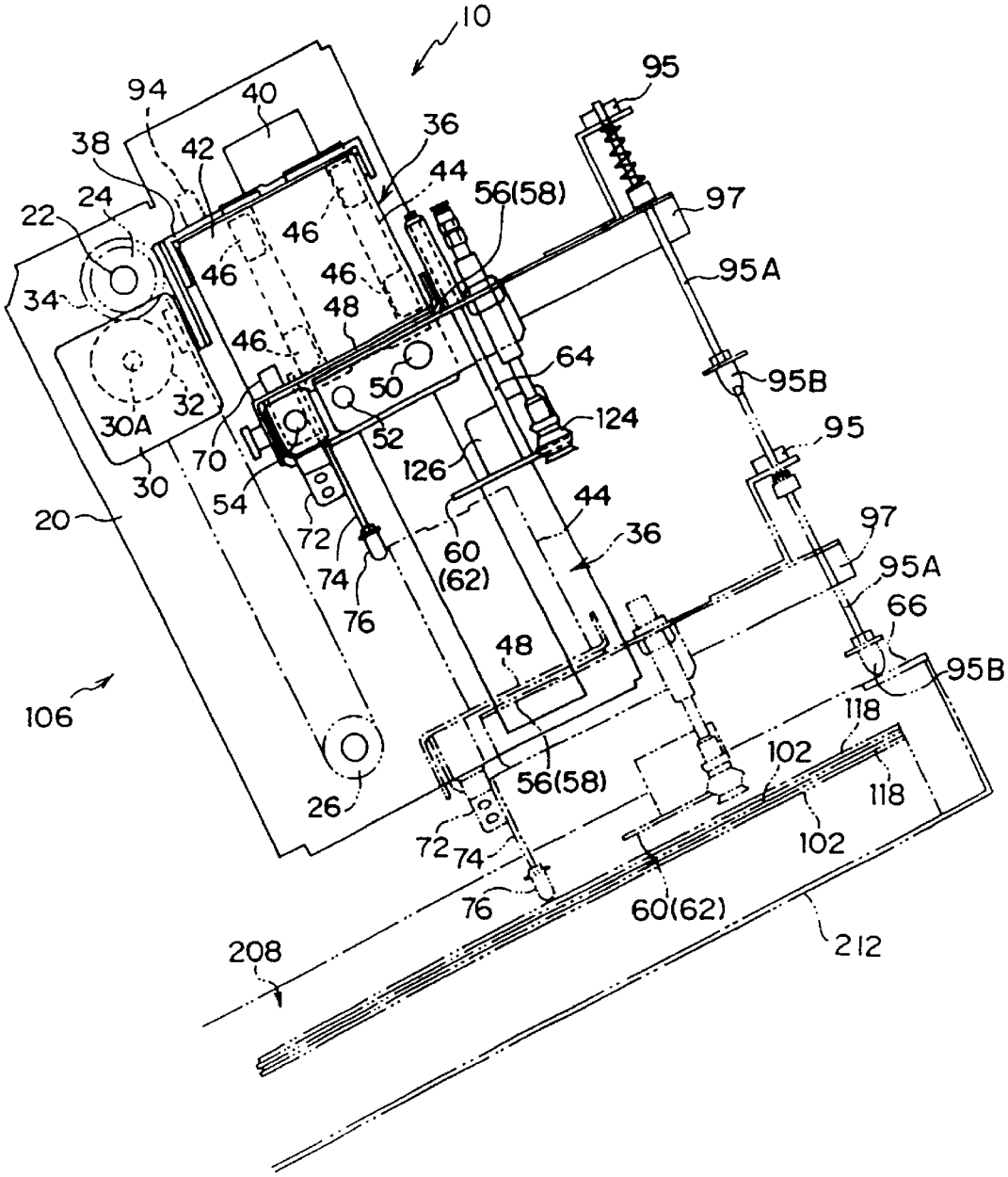
FIG. 3 is a schematic structural diagram of the sheet feeding section having the suction unit to which the present invention is applied.

As shown in FIG. 3, the photopolymer plates 102 are each protected in such a manner that the surface thereof (on which a photosensitive layer formed by a photopolymerization layer is provided) is covered by interleaf paper 118. The photopolymer plates 102 and interleaf papers 118 are thus alternately stacked in the cassette 208. As shown in FIGS. 1 and 2, the cassette 208 is equipped with a shutter 210, and due to the shutter 210 being closed in cases other than when it is placed in a dark room, the photopolymer plates 102 are prevented from being undesirably exposed to light.

The photopolymer plates 102 are disposed to face the sheet feeding section 106 in a state of being inclined at a predetermined angle by mounting the carriage 200 in the plate accommodating section 104. The carriage 200 is placed in the plate accommodating section 104 and the plate accommodating section 104 is placed into a light shielding state, and the shutter 210 of the cassette 208 is opened. In this state, the photopolymer plates 102 can be removed from the cassette 208.

The sheet feeding section 106 provided above the plate accommodating section 104 is equipped with a plurality of suckers or suction nozzles 124. A predetermined position at an upper end of each of the interleaf paper 118 and the photopolymer plate 102 adheres to the suckers 124 when operated, and the interleaf paper 118 and the photopolymer plate 102 are sequentially removed from the cassette 208 and transferred to the plate supplying section 108.

The plate supplying section 108 is mainly divided into the following four parts: a shared conveying portion 128 in which the photopolymer 102 or interleaf paper 118 is received from the sheet feeding section 106 and conveyed; a photopolymer plate conveying portion 130 which receives the photopolymer plate 102 and conveys the same to the surface table 110; an interleaf paper conveying portion 134 which receives the interleaf 118 and conveys the same to an interleaf paper receiving box 132 provided in the carriage 200; and a conveying switch portion 136 which functions as a guide from the shared conveying portion 128 to any one of the photopolymer plate conveying portion 130 and the interleaf paper conveying portion 134 by a switching operation.

As shown in FIG. 2, in the shared conveying portion 128, a roller 128A of a state indicated by the broken line is disposed apart from a roller 128B. When the photopolymer plate 102 or the interleaf paper 118 is removed by the sheet feeding section 106 and raised to a position of delivery, the roller 128A of another state indicated by the solid line moves toward the roller 128B and nips to convey the leading end of the raised photopolymer plate 102 or interleaf paper 118 to the conveying switch portion 136. When the interleaf paper 118 is removed from the cassette 208, the conveying switch portion 136 of a state indicated by the broken line switches the conveying portion 134. Further, when the photopolymer plate 102 is removed from the cassette 208, the conveying switch portion 136 of another state indicated by the solid line switches the conveying path so as to convey the photopolymer plate 102 to the photopolymer plate conveying portion 130.

The carriage 200 is provided with the interleaf paper receiving box 132, and the interleaf paper 118 removed from the cassette 208 by the sheet feeding section 106 is guided by the interleaf paper conveying portion 134 to the interleaf paper receiving box 132 provided in the carriage 200. A pair of rollers 144 is provided at an insertion opening 142 for the interleaf paper 118, which is formed in an upper side of the interleaf paper receiving box 132. These rollers are driven to rotate at a linear velocity slightly or about 1.1 times faster than the conveying speed in the interleaf paper conveying portion 134. As a result, when the interleaf paper 118 extends across a region between the interleaf paper conveying portion 134 and the rollers 144, it is conveyed while maintaining a predetermined tension therein, and occurrence of jamming caused by a slack or the like can be prevented.

Further, guide plates 146 formed in such a manner that a distance therebetween (in a direction along a thickness of the interleaf paper 118) gradually decreases from top to bottom in a tapered manner, are provided at the upstream side of insertion opening 142 in the direction of the conveying path of the interleaf paper 118. The guide plate 146 formed in the tapered shape and facing each other are each provided with a charge removing brush 148 so as to remove electrostatic charge from the interleaf paper 118 to be inserted in the insertion opening 142.

The pair of rollers 144 includes skewered rollers. Partition plates 150 disposed at the side of the rollers have recesses complementary to the rollers of the skewered rollers, such that the rollers are disposed within the recesses. As a result, even if a portion of the interleaf paper 118 received in the interleaf paper receiving portion 132 contacts the rollers 144, wrapping of the interleaf paper 118 around the rollers 144 can be prevented by the partition plates 150.

On the other hand, when the photopolymer plate 102 is removed from the cassette 208, the conveying switch portion 136 switches the conveying path so as to guide the photopolymer plate 102 to the photopolymer plate conveying portion 130. Thereafter, the photopolymer plate 102 is transferred by the photopolymer plate conveying portion 130 to the surface table (see FIG. 1) in a state of being conveyed substantially horizontally.

As illustrated in FIG. 1, the upper surface of the surface table 110 is disposed at a position lower than a position at which the photopolymer plate is horizontally conveyed in the photopolymer plate conveying portion 130. Further, there is a space or a gap between the surface table 110 and the photopolymer plate conveying portion 130 in the direction in which the photopolymer plate is conveyed. For this reason, the photopolymer plate 102 conveyed from the photopolymer plate conveying portion 130 arrives at the surface table 110 in such a manner that the leading end thereof slightly hangs, and the trailing end of the photopolymer plate 102 in the conveying direction is positioned further at the upstream side of the surface table 110 in the conveying direction of the plate 102. A movable body 152 is provided at this upstream side of the surface table 110 so as to be capable of moving close to and apart from the surface table 110.

The movable body 152 includes a temporary supporting plate, a pushing plate, a puncher, and the like, which are all not shown. Hanging of the photopolymer plate 102 conveyed onto the surface table 110 is prevented by the temporary supporting plate.

Further, the pushing plate (not shown) provided in the movable body 152 pushes the trailing end of the photopolymer plate 102 so as to cancel a diagonal feed of the photopolymer plate 102, and the photopolymer plate 102 is conveyed to a predetermined reference position in the conveying direction. The reference position is set in such a manner that the trailing end of the photopolymer plate 102 in the conveying direction slightly protrudes from the surface table 110.

At the reference position, sensors (not shown) are respectively provided at plural positions including two corners at the trailing end of the photopolymer plate 102 in the conveying direction. Due to the trailing end of the photopolymer plate 102 being detected by the sensors, pushing by the pushing plate is stopped. Further, these sensors are also used to detect positions on the photopolymer plate 102 along the transverse direction perpendicular to the conveying direction. That is, the corners of the photopolymer plate 102 and the sensors are caused to coincide with each other by the surface table 110 moving in the transverse direction of the photopolymer plate 102 perpendicular to the conveying direction, and the position at which the corners of the photopolymer plate 102 and the sensors coincide with each other is registered as an initial position of the photopolymer plate 102.

The position of the photopolymer plate 102 moved to the initial position is set so as to become a relative position for a scanning/exposure starting position in the exposure section 112. In this state, the photopolymer plate 102 is sucked and held by negative pressure supplied to a suction groove (not shown) provided in the surface table 110. The puncher provided in the movable body 152 punches holes in the photopolymer plate 102 sucked and held by the surface table 110.

The surface table 110 is movable in a reciprocating manner (which is common to a movement for positioning in the transverse direction perpendicular to the conveying direction) at a uniform velocity between a first position indicated by the solid line in FIG. 1 at which the photopolymer plate 102 is received from the photopolymer plate conveying portion 130 and a second position indicated by the phantom line in FIG. 1 at which the photopolymer plate 102 is accommodated in the exposure section 112.

In the exposure section 112, a scanning unit 164 is provided at a position above the conveying path on the surface table 110. Main scanning in a direction perpendicular to the moving direction of the surface table 110 is carried out using laser beams which are controlled so as to be modulated in accordance with an image signal. Forward movement of the surface table 110 is sub-scan movement. Thus, during the forward movement of the surface table 110 to the exposure section 112, an image is recorded on the photopolymer plate 102 held on the surface table 110, and the photopolymer plate 102 is moved back to an original position by backward movement of the surface table 110. After the photopolymer plate 102 placed on the surface table 110 has been moved back to the original position, vacuum application is terminated thereby releasing the plate 102.

In correspondence to the surface table 110 on which the photopolymer plate 102 with an image being recorded is moved back to the original position, a discharging mechanism section 166 placed in a waiting state at the side of the trailing end of the photopolymer plate 102, in the conveying direction of the plate 102 by the photopolymer plate conveying portion 130, passes above the surface table 110 and moves to the leading end of the photopolymer plate 10.

The discharging mechanism section 166 is provided with hook portions 166A for supporting the trailing end of the photopolymer plate 102. Due to the trailing end of the photopolymer 102 protruding from the surface table 110 being lifted up by the temporary supporting plate provided in the movable body 152 and the discharging mechanism section 166 being moved in the direction in which the photopolymer plate 102 is conveyed, the photopolymer plate 102 is conveyed to the buffer section 114 at the downstream side of the surface table 110 by being caught by the hook portions 166A and accompanied with the movement of the discharging mechanism section 166. In the buffer section 114, the photopolymer plate 102 is smoothly conveyed out to the automatic processing apparatus 116 while eliminating a difference between a speed at which it is discharged by the discharging mechanism section 106 and a speed at which it is conveyed in the automatic processing apparatus 116.

Figure 4:
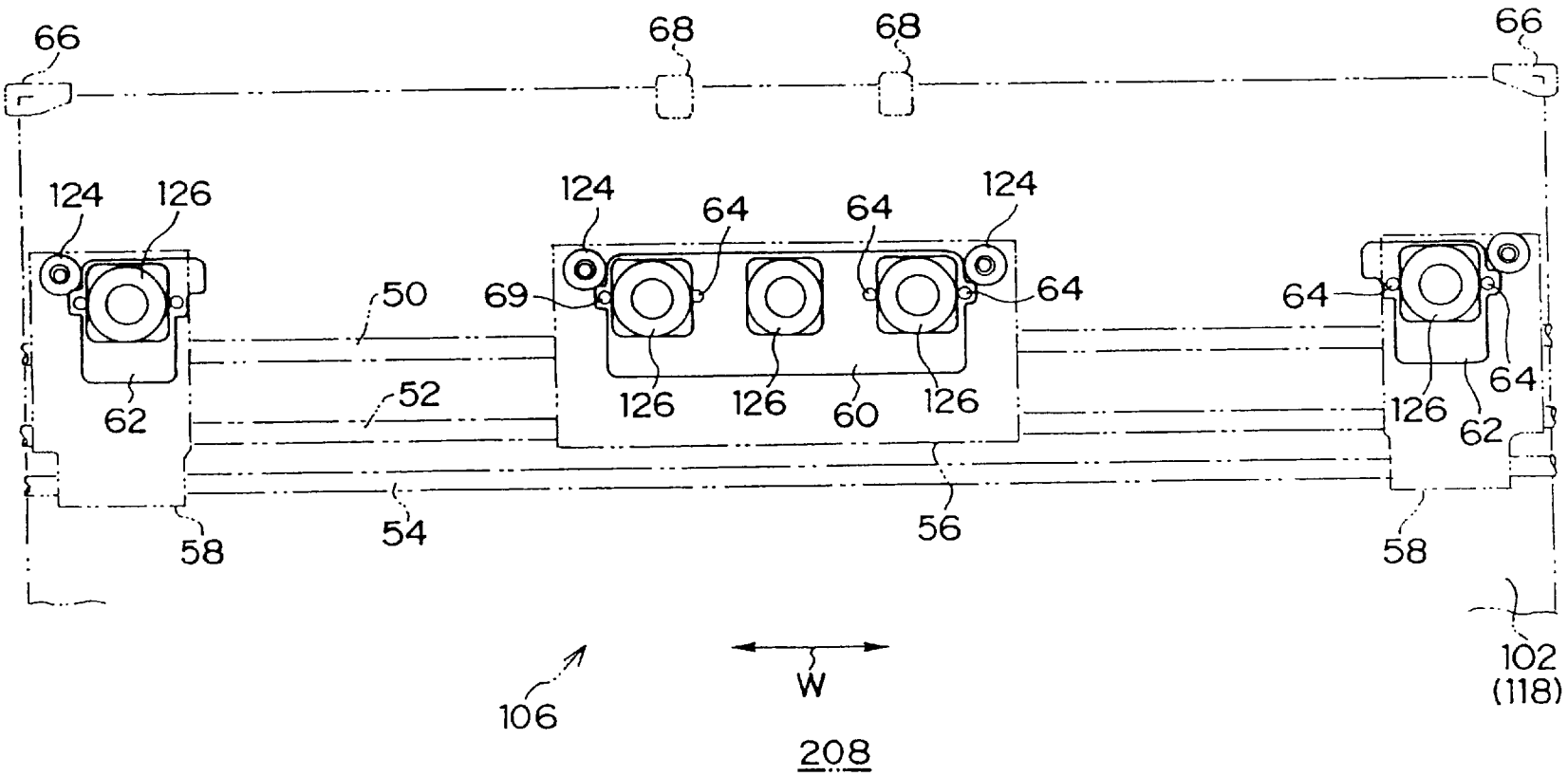
FIG. 4 is a schematic diagram of the main portion of the suction unit, which shows relative positions of suckers and suction fans with respect to photopolymer plates accommodated in a cassette.
Figure 5:
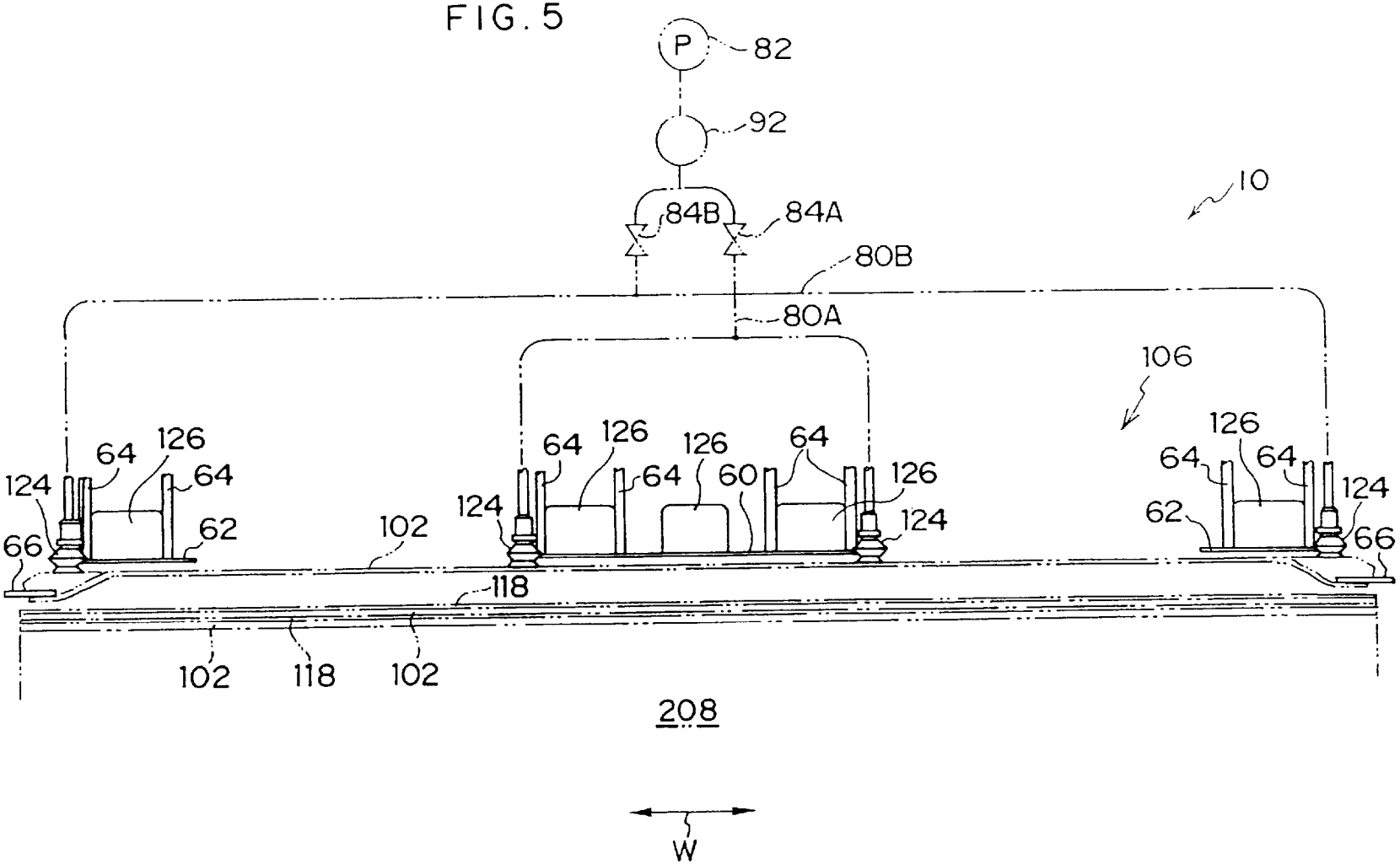
FIG. 5 is a schematic diagram of the main portion of the suction unit, which shows the relative positions of the suckers and the suction fans with respect to photopolymer plates accommodated in the cassette, when seen from a side different from the view of FIG. 4.

FIGS. 3 through 5 each show the sheet feeding section 106 provided in the automatic exposure apparatus 100. In the embodiment of the present invention, the photopolymer plate 102, which is one kind of printing plate precursor, is used as a plate-shaped member and the interleaf paper 118 is used as a sheet material. The photopolymer plates 102 and the interleaf papers 118 are accommodated in the cassette 208 in a state of being alternately stacked on the bottom plate 212. In FIGS. 4 and 5, the transverse direction of the photopolymer plate 102, i.e., the direction perpendicular to the plane of FIG. 3, perpendicular to the direction in which the photopolymer plate 102 is conveyed between the shared conveying portion 128 and the photopolymer plate conveying portion 130, is indicated by a double-headed arrow W.

As illustrated in FIG. 3, the sheet feeding section 106 is provided with a pair of side plates 20 (only one of them is shown), and a suction unit 10 is disposed between the pair of side plates 20. The cassette 208 placed on the carriage 200 is made to face the suction unit 10 at a fixed position and also at a fixed interval with respect to the suction unit 10 with the carriage 200 being mounted at a predetermined position in the plate accommodating section 104.

In the suction unit 10, a shaft 22 is disposed so as to span between the pair of side plate 20 at upper portions of the side plates 20 at the upper side in FIG. 3. Sprockets 24 are respectively mounted at both ends of the shaft 22 at the sides of plates 20. Further, a sprocket 26 is mounted in the side plate 20 at the side of the cassette 208, and a chain 28 is entrained between and around the sprockets 24 and 26.

An elevating motor 30 serving as an elevator is mounted at one of the pair of side plates 20, and a gear 32 mounted on a driving shaft 30A of the elevating motor 30 meshes with a gear 34 mounted at the shaft 22. As a result, when the elevating motor 30 is driven, the sprockets 24 and 26 are rotated and the chain 28 is moved between the sprockets 24 and 26 in a direction substantially perpendicular to the surface of the photopolymer plates 102 stacked in the cassette 208.

The suction unit 10 includes a suction frame 36 disposed between the side plates 20. The suction frame 36 is connected to the chain 28 via a bracket 383. Further, guide rails 40 are respectively mounted to the side plates 20 on the surface thereof facing each other. The suction frame 36 is provided with side bases 42 which face the side plates 20 respectively. Sliders 44 are mounted at the side bases 42 and each include plural pairs of frames 46 disposed with the guide rails 40 interposed therebetween.

As a result, when the elevating motor 30 is driven, the suction frame 36 moves along the guide rail 40 and moves up and down substantially perpendicular to the photopolymer plate 102 in the cassette 208.

As the elevating motor 30, a DC motor having an encoder, or a pulse motor is used. Accordingly, in the suction unit 10, the speed at which the suction frame 36 moves, and the amount by which the suction frame 36 moves, can be properly controlled.

A supporting base 48 is provided in the bracket 38 of the suction frame 36 so as to face the cassette 208. Three shafts 50, 52 and 54 extend though the supporting base 48 along the transverse direction of the photopolymer plate 102.

As illustrated in FIG. 4, a bracket 56 is mounted so as to straddle over the shafts 50 and 52, and a bracket 58 is mounted so as to straddle over the shafts 50, 52 and 54. The brackets 56 and 58 are mounted, for example, in such a manner that the shafts 50, 52 and 54 pass through slide blocks (not shown) provided at the rear side thereof.

The bracket 56 faces a transverse-direction intermediate portion of the photopolymer plate 102 accommodated in the cassette 208, and the brackets 58 respectively face both the transverse-direction end portions of the photopolymer plate 102. The bracket 56 is fixed at a predetermined intermediate position between the shafts 50 and 52, and the brackets 58 are disposed respectively at sides of both ends of the shafts 50, 52 and 54 and can each be moved in directions in which it moves away and towards the bracket 56 in accordance with the size of the photopolymer plate 102 accommodated in the cassette.

A fan base 60 is disposed below the bracket 56 and a fan base 62 is disposed below each of the bracket 58. The fan base 60 and the fan bases 62 are supported in such a manner as to be respectively connected to the brackets 56 and 58 by a plurality of shafts 64. As shown in FIG. 5, respective lower surfaces of the fan bases 60 and 62 are each disposed linearly and parallel to the surface of the photopolymer plate 102 accommodated in the cassette 208.

As illustrated in FIGS. 4 and 5, the fan base 60 is provided with a plurality of suction fans 126 along the transverse direction of the photopolymer plate 102, and each of the fan bases 62 is provided with one suction fan 126. For example, the present embodiment employs three suction fans 126. The suction fan 126 includes a vent opening portion at the central portion thereof, and is constructed to suck air from the fan bases 60 and 62 at the side of the cassette 208 by driving a fan motor (not shown) to blow out air.

As illustrated in FIG. 4, the bracket 56 is provided with the suction nozzles 124 which are respectively mounted at both sides of the bracket 56 with the fan base 60 interposed therebetween. The bracket 58 are each provided with the suction nozzles 124 mounted at an outer side of the bracket 58 along the transverse direction of the photopolymer plate 102. As illustrated in FIGS. 4 and 5, these suction nozzles 124 are each disposed near the suction fan 126.

An end of the suction nozzle 124 slightly protrudes from the rear surface of the fan base 60 or 62 toward the cassette 208. Further, when the end of the suction nozzle 124 abuts against the photopolymer plate 102 or the interleaf paper 118 and is pushed down, the suction nozzle 124 is apt to be flattened.

As shown in FIG. 5, the suction nozzles 124 are each connected to a negative pressure source such as a vacuum pump 82 via, for example a pipe line 80A or a pipe line 80B. Further, the pipe lines 80A and 80B are respectively provided with solenoid valves 84A and 84B. Due to the solenoid valves 84A and 84B being opened in a state in which the vacuum pump 82 is actuated, negative pressure is fed to each of the suction nozzles 124. At this time, since the suction nozzles 124 is apt to be flattened by abutting against the photopolymer plate 120 or the interleaf paper 118 can reliably be suction-adhered by the suction nozzle 124.

The end of each of the suction nozzles 124 slightly protrudes from the rear surface of the fan base 60 or 62 and a predetermined stepped portion is formed between the end of the suction nozzle 124 and the lower surface of the fan base 60 or 62. When the suction nozzle 124 is made to abut against the photopolymer plate 102 or the interleaf paper 118, a small clearance is formed between the fan bases 60 and 62, and the photopolymer plate 102 or the interleaf paper 118 without the fan bases 60 and 62 contacting the surface of the photopolymer plate 102 or interleaf paper 118. As a result, the photopolymer plate 102 is prevented from being damaged due to the fan bases 60 and 62 contacting the photopolymer plate 102, and a suction efficiency of the suction fan 126 at the time of drawing in the interleaf paper 118 by suction, becomes higher.

In the suction unit 10, when the interleaf paper 118 is removed from the cassette 208, first, the suction fans 126 are actuated in a state of being moved close to the interleaf paper 118 with a predetermined space therebetween, and the interleaf paper 118 is lifted up due to suction force of the suction fans 126. Thereafter, the interleaf paper 118 is suction-adhered to the suction nozzles 124.

Further, in the suction unit 10, when the interleaf paper 118 is suction-adhered to the suction nozzles 124, the suction frame 36 is moved upward to a position of delivery to the shared conveying portion 128 in which the interleaf paper 118 faces the rollers 128A and 128B of the shared conveying portion 128, and the interleaf paper 118 is nipped by the rollers 128A and 128B of the shared conveying portion 128. In this state, suction holding of the interleaf paper 118 by the suction nozzles 124 is released and the interleaf paper 118 is passed to the shared conveying portion 128.

Moreover, in the suction unit 10, when the photopolymer plate 102 is removed from the cassette 208, the suction frame 36 is moved downward to a position at which all of the suction nozzles 124 contact the photopolymer plate 102, and the photopolymer plate 102 is suction-adhered to the suction nozzles 124. Thereafter, the suction frame 36 is moved upward to the position of delivery and the photopolymer plate 102 is lifted up and passed to the shared conveying portion 128. Sheet feeding of the photopolymer plate 102 will be described later in details.

As illustrated in FIGS. 3 through 5, to the cassette 208 is provided with separation plates 66 at predetermined positions which face the peripheral edge of the photopolymer plate 102. When the photopolymer 102 is lifted up by the suction nozzles 124, the peripheral edge of the photopolymer plate 102 is caught by the separation plates 66 and thereby bends between the separation plates 66 and the suction nozzles 124.

In the suction unit 10, due to the suction nozzles 124 being lifted up to a predetermined height with respect to the separation plates 66 provided in the cassette 208, the photopolymer plate 102 is provided so as to bend between the suction nozzles 124 and the separation plates 66 at a predetermined curvature. Due to the photopolymer plate 102 being bent between the suction nozzles 124 and the separation plates 66 at an appropriate curvature, the photopolymer plate 102 is separated from an interleaf paper 118 lifted up by closely contacting a lower surface of the photopolymer plate 102, or from a subsequent photopolymer plate 102. As a result, only the uppermost photopolymer plate 102 can be lifted up from the cassette 208.

As illustrated in FIG. 4, the cassette 208 is also provided with interleaf paper keepers 68 facing the upper end of the interleaf paper 118. When the cassette 208 is mounted on the carriage 200 in an inclined manner, the interleaf paper keepers 68 are provided to abut against the uppermost interleaf paper 118 to prevent curling and falling of the interleaf paper 118, which is typically not firm.

Figure 6:
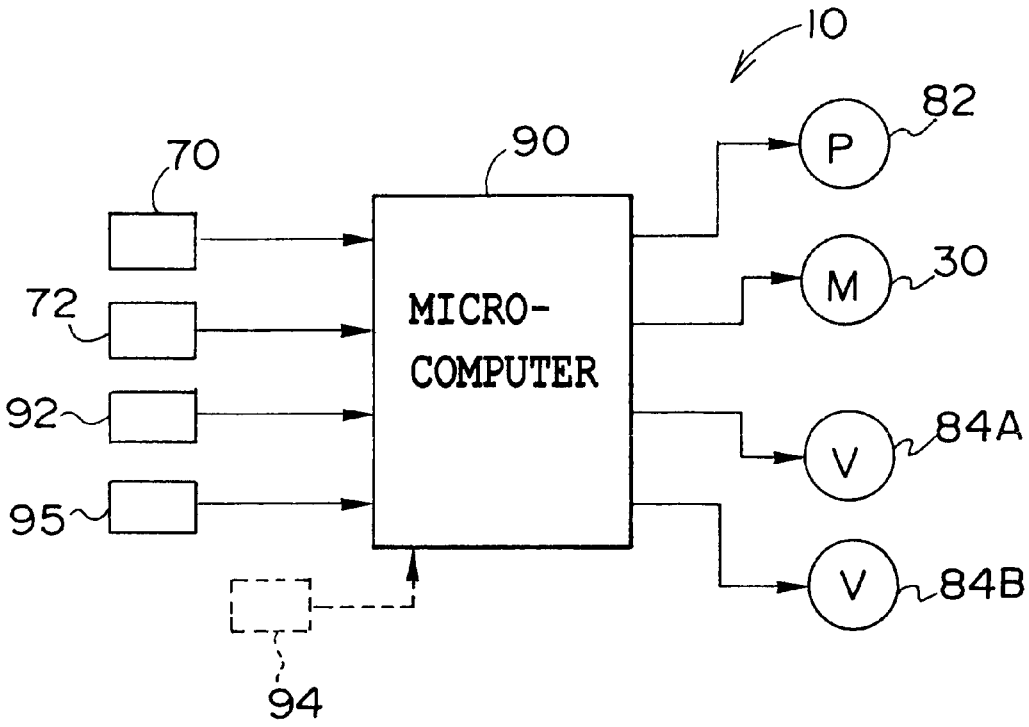
FIG. 6 is a block diagram which schematically shows connection to a sheet feeding controller provided in the suction unit.

As illustrated in FIG. 6, the suction unit 10 includes a sheet feeding controller 90 having a microcomputer. The sheet feeding controller 90 operates based on a signal from a main controller (not shown) of the automatic exposure apparatus 100, and controls removal of the photopolymer plate 102 and the interleaf paper 118 from the cassette 208.

The elevating motor 30, vacuum pump 82, solenoid valves 84A and 84B, and the like are connected via a driver (not shown) to the sheet feeding controller 90. Further, a pressure sensor 92, a separation plate detecting sensor 95, a plate/paper discrimination sensor 72, and a plate detecting sensor 70 are also connected to the sheet feeding controller 90.

As illustrated in FIG. 3, a separation plate detecting sensor 95 is provided at a top end of a bracket 97 which is disposed at the top end of the cassette 208 from the bracket 56. The separation plate detecting sensor 95 has a detecting shaft 95A which protrudes to a separation plate 66 from the bracket 97, and an abutting portion 95B is provided at the top end of the detecting shaft 95A. The abutting portion 95B is disposed so as to oppose the separation plate 66. Consequently, the separation plate 66 is detected when a suction frame 36 moves closer from the cassette 208 and the separation plate detecting sensor 95 contacts the separation plate 66. This position is defined as a reference for the separating position for the suction frame 36 including suction nozzles 124 and the like.

Usually, the suction frame 136 is placed in a waiting state on a top portion of a guiding rail 40 as an initial point referred to as HP below. HP detecting sensor 94 can be also provided.

Further, the plate/paper discrimination sensor 72 is mounted at the bracket 58 so as to face the peripheral edge of the photopolymer plate 102, that is a non-image region, accommodated in the cassette 208. As the plate/paper discrimination sensor 72, for example, a reflection type photosensor is used. Light irradiated from a light projecting portion and reflected by the photopolymer plate 102 or the interleaf paper 118 is received by a light receiving portion.

At this time, an amount of the received light varies due to a difference in reflectance between the photopolymer plate 102 and the interleaf paper 118, and therefore, a determination can be made as to whether the uppermost layer is the photopolymer plate 102 or the interleaf paper 118 by a sheet feeding controller 90. The distinction between the photopolymer plate 102 and the interleaf paper 118 may also be made, using a pressure sensor provided in a pipe line for feeding negative pressure for the suction nozzle 124, on the basis of the difference between a pressure generated when the interleaf paper 118 is suction-adhered to the suction nozzle 124, and a pressure generated when the photopolymer plate 102 is suction-adhered to the suction nozzle 124. That is, when the photopolymer plate 102 is located at the uppermost position, a predetermined negative pressure is detected by the pressure sensor. When the interleaf paper 118 is located at the uppermost position, negative pressure to be fed for the suction nozzle 124 leaks through the interleaf paper 118 and the negative pressure to be detected by the pressure sensor is reduced approximately to zero.

Further, the plate detecting sensor 70 is provided as an approach detecting base 48 of the suction frame 36 toward an interior of the cassette 208. An abutting portion 76 is formed at an end of the detecting shaft 74. The abutting portion 76 of the detecting shaft 74 protrudes further toward the cassette 208 than the suction nozzles 124. When the suction frame 36 is moved downward from the original position thereof toward the cassette 208, the abutting portion 76 abuts against the photopolymer plate 102 or the interleaf paper 118 within the cassette 208 earlier than the suction nozzles 124.

The detecting shaft 74 contracts due to the abutting portion 76 abutting against the photopolymer plate 102 or the interleaf paper 118 covers the upper or photosensitive surface of the photopolymer plate 102. The plate detecting sensor 70 is turned on due to contraction of the detecting shaft 74.

The sheet feeding controller 90 detects, based on the result of detection of the plate detecting sensor 70, that the suction nozzles 124 provided in the suction frame 36 have moved to a predetermined position close to the photopolymer plate 102 or the interleaf paper 118 within the cassette 208.

In the suction unit 10, the position at which the plate detecting sensor 70 is turned on, is a position at which the interleaf paper 118 is drawn in by the suction fans 126. In the sheet feeding controller 90, when the interleaf paper 118 is located at the uppermost position of the cassette 208, downward movement of the suction frame 36 is stopped by turning on the plate detecting sensor 70, and the suction fans 126 are actuated to start suction of the interleaf paper 118.

Further, in the suction unit 10, an amount by which the suction nozzles 124 or the suction frame 36 move until all of the suction nozzles 124 closely contact the photopolymer plate 102 from the time at which the plate detecting sensor 70 is turned on, is previously set. As a result, in the sheet feeding controller 90, when the photopolymer plate 102 is located at the uppermost position of the cassette 208, the suction nozzles 124 are moved downward by the preset amount of movement by turning on the plate detecting sensor 70 while feeding negative pressure to the suction nozzles 124, and the photopolymer plate 102 is reliably suction-adhered to the suction nozzels 124.

The cassette 208 is assembled such that the bottom plate 212 and the separation plates 66 are disposed at a fixed interval. In the automatic exposure apparatus 100, due to the carriage 200 being mounted at a predetermined position in the plate accommodating section 104, the cassette 208 loaded in the carriage 200 is disposed at a fixed interval with respect to the suction unit 10 or the suction nozzles 124.

Here, in the sheet feeding controller 90, a distance between the suction nozzles 124 disposed in advance at the original positions, and the bottom plate 212 of the cassette 208 is measured. Based on the result of this measurement, a position at which the photopolymer plate 102 is separated, is set such that the photopolymer plate 102 bends between the separation plates 66 of the cassette 208 and the suction nozzles 124 at an appropriate curvature. When the photopolymer plate 102 is suction-adhered to the suction nozzles 124, the suction nozzles 124 are moved upward to the above-described set position of separation.

As a result, in the suction unit 10, the photopolymer plate 102 suction-adhered to the suction nozzles 124 is bent at a fixed curvature, and the interleaf paper 118 disposed immediately below the photopolymer plate 102, or a subsequent photopolymer plate 102 is reliably separated from the photopolymer plate 102 adhered to the suction nozzles 124.

In the suction unit 10, the amount by which all of the suction nozzles 124 move until they closely contact the photopolymer plate 102 from the time at which the plate detecting sensor 70 is turned on, is previously set. That is, when all of the suction nozzles 124 closely contact the bottom plate 212 of the cassette 208, no leakage of negative pressure from the suction nozzles 124 occurs. Therefore, a predetermined negative pressure is detected by the pressure sensor 92 provided between the vacuum pump 82 and the solenoid valves 84A and 84B.

In the sheet feeding controller 90, in a state in which an empty cassette 208 having no photopolymer plate 102 or interleaf paper 118 accommodated therein is mounted, the suction frame 36 is moved downward at a fixed speed, and the time it takes for the pressure detected by the pressure sensor 92 to reach a predetermined value after the plate detecting sensor 70 has been turned on, is measured. The amount by which the suction nozzles 124 move when the suction nozzles 124 suction adhere to the photopolymer plate 102, is set from the above-described measured time.

Figure 7A:
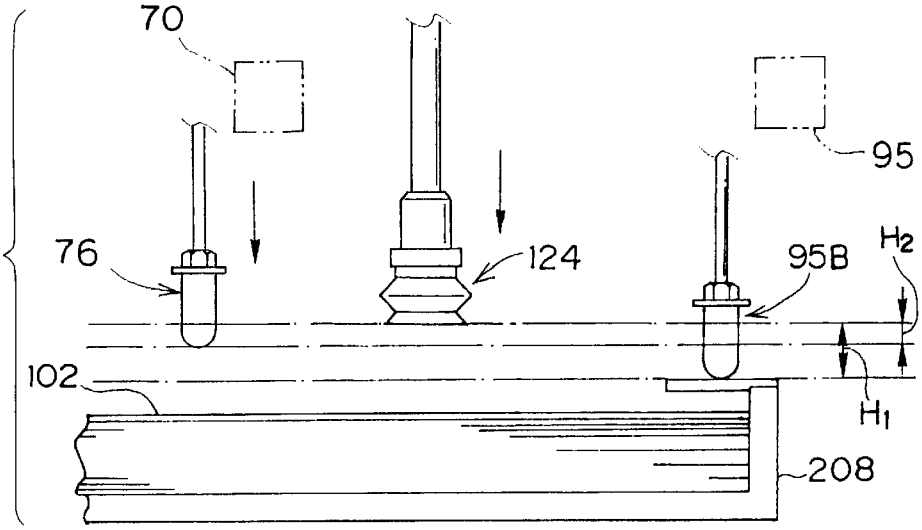
FIG. 7A is a conceptual diagram showing relative positions of a plate detecting sensor, suction nozzles and a separation plate detecting sensor with respect to each other at time of separating a separation plate.
Figure 7B:
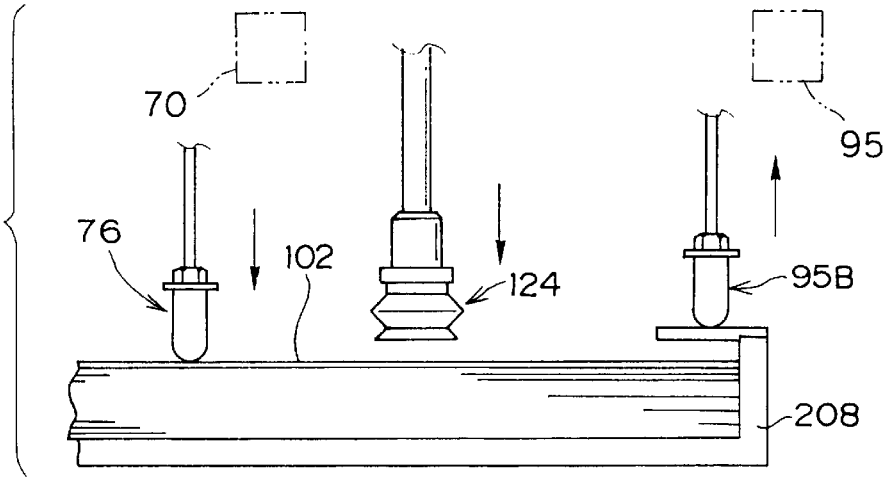
FIG. 7B is a conceptual diagram showing relative positions of a plate detecting sensor, suction nozzles and a separation plate detecting sensor with respect to each other at time of a detecting a separation plate.
Figure 7C:
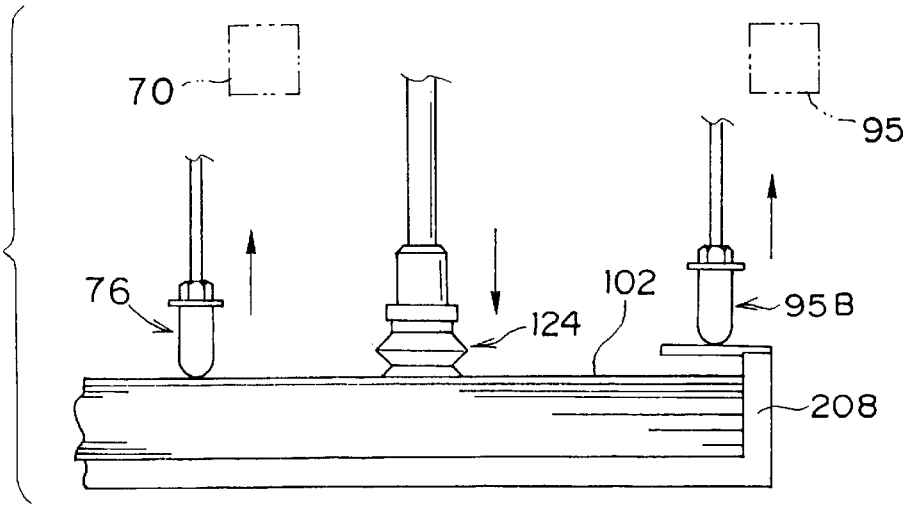
FIG. 7C is a conceptual diagram showing relative positions of a plate detecting sensor, suction nozzles and a separation plate detecting sensor with respect to each other at a time of suction-adhering.

FIGS. 7A through 7C are conceptual diagrams each showing a relationship between a suction nozzle 124, a separation plate 66, an abutting portion 76 of a contact sensor and an abutting portion 95B of a separation plate detecting sensor.

FIG. 7A shows a position in which a suction frame 36 is moved downward, and a separation plate detecting sensor 95 is abutted against a separation plate 66.

At this position, the separation plate detecting sensor 95 detects the separation plate 66. At this time a sucking surface of the suction nozzle 124 is at a suitable position for separation by the separation plate 66 when the suction nozzles 124 sucks the photopolymer plate 102 and causes it to be raised. Therefore, width $H_1$ between the sucking surface of the suction nozzle 124 and the separation plate 66 is predetermined previously, drive controlling pulse of a driving motor 30 detected by the separation plate detecting sensor 95 is memorized.

Detecting position of a plate detecting sensor 70 is determined by $H_2$, which is related to a sucking surface of the suction nozzles 124. A relationship between $H_1$ and $H_2$ is $H_1>H_2$. Therefore, detecting position of a plate detecting sensor 70 is between the sucking surface of the suction nozzles 124 and detecting position of a separation plate detecting sensor 95.

Further, FIG. 7B shows that the uppermost photopolymer plate 102 stacked in the cassette 208 is detected by a plate detecting sensor 70. FIG. 7C shows that the suction frame 124 adheres to the uppermost photopolymer plate 102.

Figure 8:
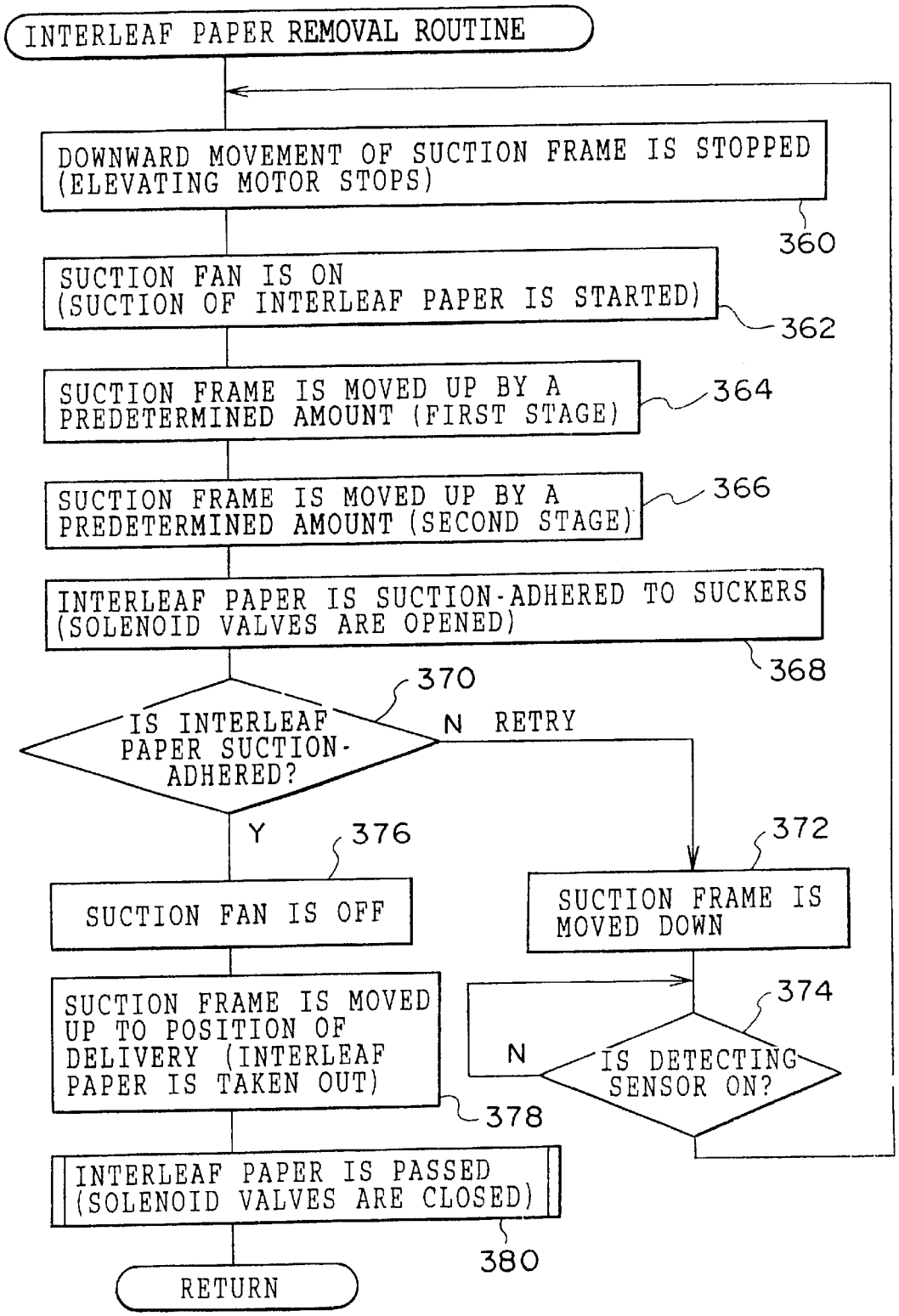
FIG. 8 is a flow chart showing an example of take-out processing of interleaf papers from a cassette.

FIG. 8 shows an example of removal processing for the interleaf paper 118 in the suction unit 10. The flow chart is drawn based on determination that the interleaf paper 118 is located at the uppermost position of the cassette 208. In the first step 360, downward movement of the suction nozzles 124 is stopped by stopping the operation of the elevating motor 30.

The operation of stopping the downward movement of the suction nozzles 124 may be carried out prior to the process of step 364 in the above-described flow chart. Further, when the interleaf paper 118 is removed, switching of the conveying path is carried out in the conveying switch portion 136 so that the interleaf paper 118 is conveyed from the shared conveying portion 128 to the interleaf paper conveying portion 134. Further, when the interleaf paper 118 is constantly located at the uppermost position, removal of the interleaf paper 118 may first be carried out without making a distinction between the plate and the paper.

In the subsequent step 362, the suction fans 126 are actuated to suck in air in the vicinity of the surface of the interleaf paper 118. In the suction unit 10, when the plate detecting sensor 70 is turned on, the fan bases 60 and 62 are brought into the state of moving close to the surface of the uppermost interleaf paper 118 at a predetermined distance. Due to the suction fans 126 being actuated in the above-described state, the interleaf paper 118 is released from closely contacting the photopolymer plate 102 disposed immediately below the interleaf paper 118, and the interleaf paper 118 is partially lifted up by the suction fans 126.

In the subsequent step 364, first, the elevating motor 30 is driven to reverse a little and the suction flame 36 is lifted up to a height, for example, 3 mm. As a result, the suction fans 126 move slightly upward and the interleaf paper 118 sucked by the suction fans 126 is also raised to a small extent. Accordingly, a region of the interleaf paper 118 released from closely contacting the photopolymer plate 102 is extended.

In step 366, the suction frame 36 is moved upward, for example, 2 mm until the suction nozzles 124 are lifted up or the plate detecting sensor 70 is turned off. Consequently, the upper end of the interleaf paper 118 is raised away from an underlying photopolymer plate 102.

When the fan bases 60 and 62 are moved upward step by step as described above, the closely contacting state between the uppermost interleaf paper 118 and the underlying photopolymer plate 102 is released due to the suction force of the suction fans 126. The interleaf paper 118 is raised away from the photopolymer plate 102. In step 368, negative pressure is fed to the suction nozzles 124 by, for example, opening the solenoid valves 84A and 84B for feeding negative pressure to the suction nozzles 124, and the interleaf paper 118 is suction-adhered to the suction nozzles 124. The vacuum pump 82 is turned on at a predetermined timing during downward movement of the suction nozzles 124 from the original positions or during operation of the automatic exposure apparatus 100. Further, the fan bases 60 and 62 are moved upward at the two stages, but these fan bases may also be moved upward to a position corresponding to the position in step 366 in a single operation of moving upward.

In step 370, it is confirmed as to whether the suction nozzles 124 have reliably suction-adhered the interleaf paper 118. A determination as to whether the suction nozzles 124 have suction adhered to the interleaf paper 118, can be made from, for example, the pressure detected by the pressure sensor 92. When it is determined that the suction nozzles 124 have not suction adhered to the interleaf paper 118, that is, when the determination of step 370 is negative, the process proceeds to step 362 in which retry is set, via the downward movement of the suction nozzles 124 in 372 and detecting by the plate detecting sensor 70 in step 374.

On the other hand, when the suction nozzles 124 suction adhere to the interleaf paper 118, that is, when the decision of step 370 is affirmative, the process proceeds to step 376 in which the suction fans 126 are turned off. As further shown in steps 378 and 380, the suction nozzles 124 are moved upward to the position of delivery to the shared conveying portion 128 so that the interleaf paper 118 is transferred to the shared conveying portion 128, and the solenoid valves 84A and 84B are closed to release suction holding of the interleaf paper 118 by the suction nozzles 124.

When the uppermost interleaf paper 118 is removed from the cassette 208 as described above, the process proceeds to the start of the flow in FIG. 8 where the suction frame 36 or suction nozzles 124 is moved to the initial position. When the photopolymer plate 102 are successively removed, downward movement of the suction frame 36 from the position of delivery may be started without moving the suction frame 36 to the initial position.

Figure 9A:
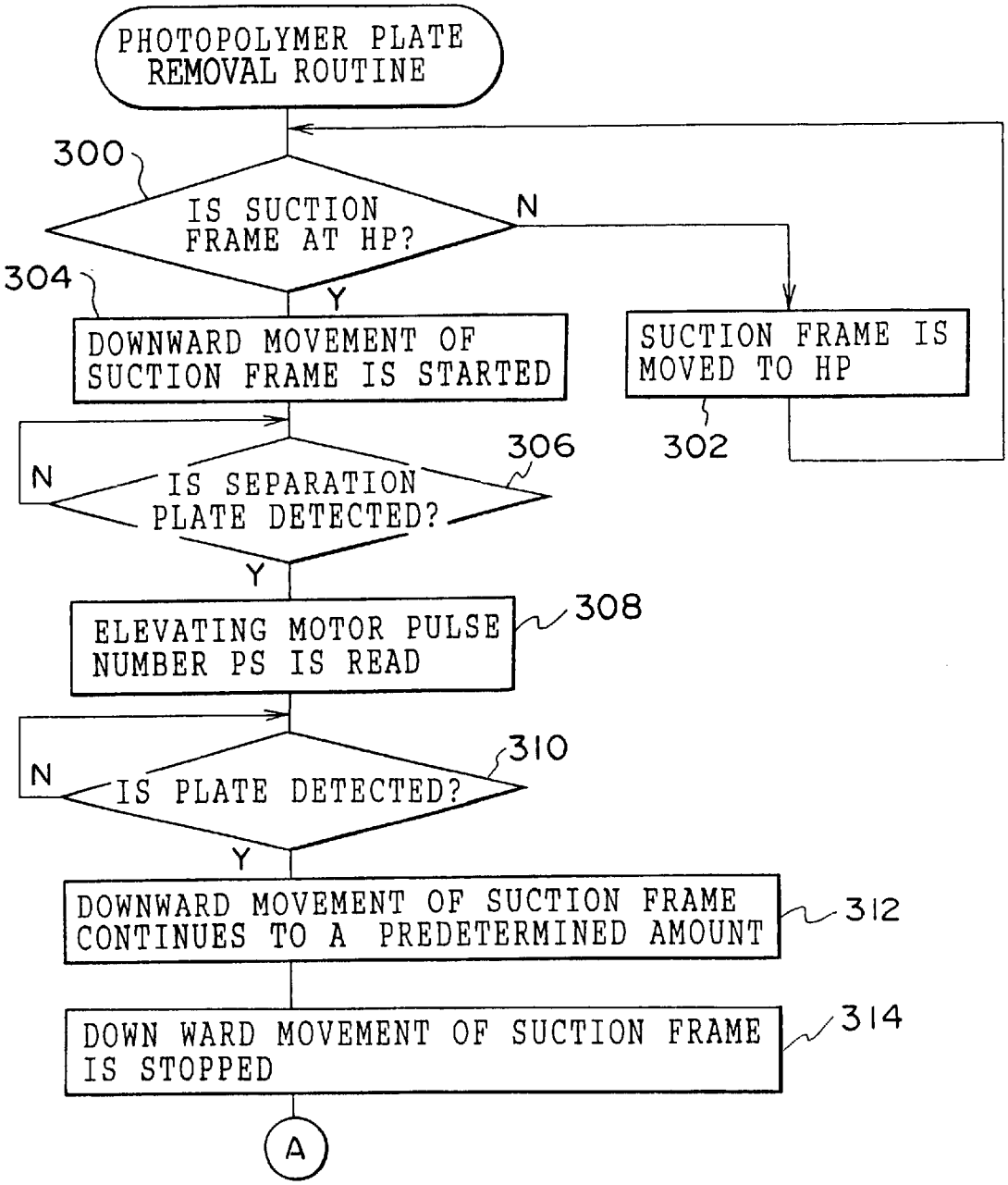
FIGS. 9A and 9B are flow charts showing an example of take-out processing of photopolymer plates from a cassette.
Figure 9B:
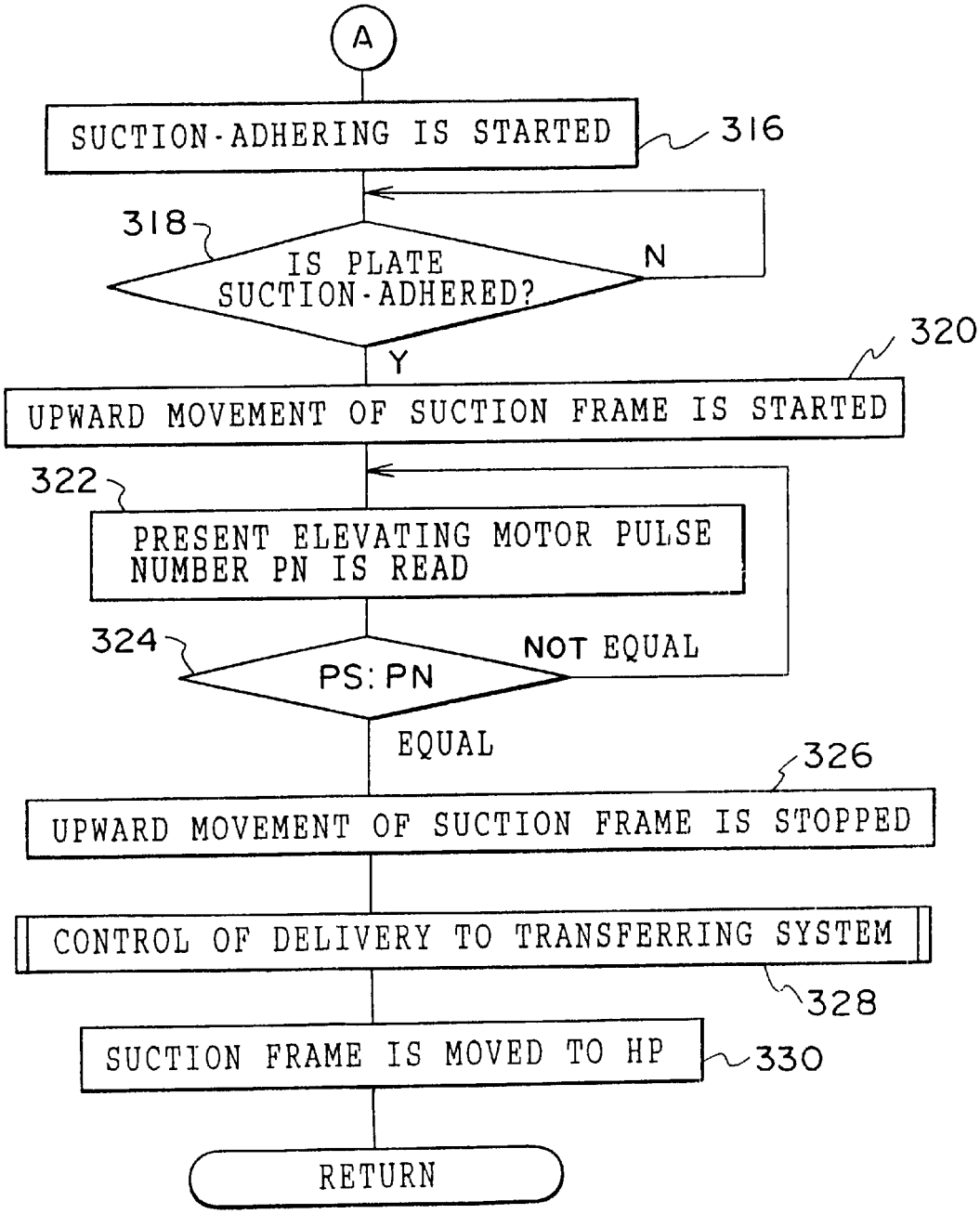

FIGS. 9A and 9B schematically show removal processing of the plate 102. When the photopolymer plate 102 is removed, the conveying switch portion 36 is switched on and the conveying path from the shared conveying portion 128 to the photopolymer plate conveying portion 130 is formed.

At first, in step 300, whether the suction frame 36 is at HP (initial position) or not is determined. When the result is negative, the process proceeds to step 302, then the suction frame 36 is returned to HP by driving the elevating motor 30, and the process proceeds to step 304. In this case, with the presence of HP sensor 94, HP discrimination can be determined easily by the detection status of the HP sensor 94. However HP sensor 94 is not essential, for HP can be discriminated by driving the elevating motor and detecting load current from the motor.

Further, when the result is determined as affirmative in step 300, movement of the suction frame is not needed. The process proceeds to step 304.

In step 304, downward movement of the suction frame is started by driving the elevating motor 30. By this movement, the suction frame 36 is moved toward the cassette 208.

During this movement in step 306, whether a separation plate 66 mounted on the cassette 208 is detected by a separation plate detecting sensor 95 is determined in step 306. An abutting portion 95B mounted on the top of a shaft 95A of a separation plate detecting sensor 95 protrudes further than the suction nozzles 124 or the plate detecting sensor 70 to a downward direction toward a suction frame 36. The separation plate 66 is disposed at the uppermost position of the cassette 208 so as to be detected at first.

When the separation plate 66 is detected in step 306, the process proceeds to step 308. Drive controlling pulse number $P_S$ of the elevating motor 30 is read and recorded in memory. Here, this memorization may be temporary and may be carried out at RAM of the sheet feeding controller 90. While the term "reading" may include an action with a recording process, an operation for recording information in a hard disk or other recording media for example is not essential.

During this reading process, movement of the suction frame 36 is continued. The separation plate detecting sensor 95 abutting against the separation plate 66 is withdrawn by a supporting shaft so as not to interfere with the movement of the suction frame.

In the next step 310, whether the uppermost photopolymer plate 102 is detected or not is determined by a plate detecting sensor 70. The plate detecting sensor 70 protrudes slightly downward from a suction nozzles 124 below the suction frame 36 so as to contact against the photopolymer plate 102 earlier than the suction nozzles 124.

The result is affirmative in step 310, then the process proceeds to step 312. The suction frame 36 is moved for a predetermined amount and the movement is stopped in step 314.

A stopping position of the suction frame 36 in step 314 becomes a position where the suction surface of the suction nozzles 124 adheres to the uppermost photopolymer plate 102.

In step 316, the uppermost photopolymer plate 102 is suctionadhered to the suction nozzles 124 by supplying a negative pressure to the nozzles.

In step 318, whether the suction adherence is complete or not is determined. The determination is easily recognized by detecting the negative pressure of the suction adherence.

In step 318, when the result is affirmative, the process proceeds to step 320 and the upward movement of the suction frame 36 is started. Namely, the suction frame 36 moves away from the cassette 208.

In the subsequent step 322, the present driving controlling pulse number $P_N$ of the elevating motor 30 is detected, then in step 324, the present pulse number $P_N$ is compared to the pulse number $P_S$ at the separation plate detecting position, which was memorized previously.

Following the result of comparison in step 324, when the compared pulse numbers are not identical, the suction frame 36 continues to move upward. When the compared numbers are determined as identical, the process proceeds to step 326 and the movement of the suction frame 36 is stopped.

At this position, the suction-adhered photopolymer plate 102 can be separated from the underlying interleaf paper 118 or a photopolymer plate 102 properly. As a result, the suction-adhered uppermost photopolymer plate 102 can be transferred to a plate conveying system (step 328).

In step 330, after transfer of the plate from the suction frame 36 to the plate conveying system is completed, the suction frame 36 is moved toward HP (namely, restart of the upward movement), the process ends.

Here, with respect to the relative position between the separation plate detecting sensor 95 and the suction nozzles 124, even when a detected position of the printing plate precursor by the plate detecting sensor 70 deviates from a proper, predetermined separating position, stopping the suction frame 36 is ensured at the most optimum position. Accordingly in comparison with the prior art where the suction frame needs adjustments by repeating stopping and moving in the vicinity of the separating position to set the most optimum position, the present invention allows setting of the most preferable separating position of the suction frame 36 easily and automatically without such adjustments.

Further, when the different-sized photopolymer plates are stacked in the respective cassette 208 and the size of the photopolymer plate differs with each request, the accuracy of positioning for each cassette 208 is maintained, and a stable feeding process can be carried out.

As described above, an embodiment of the present invention provides a separation plate detecting sensor 95 to detect a position of a separation plate 66 mounted to the cassette 208. Even when a cassette 208 is changed, it does not affect the relationship between the separation plate 66 and suction nozzles 124, and an accurate feeding processing can be carried out by maintaining the device relationship between the separation plate 66 and the suction nozzles 124.

Further, in the embodiment of the present invention, the separation plate 66 is directly detected by the separation plate detecting sensor 95. If the relative position with respect to the. separation plate 66 is constant, other members may be detected. For example, a periphery of the wall around the cassette 208 may be detected. Alternatively, the bottom surface of the cassette 208, which can be seen from the clearance between the wall of the cassette 208 and photopolymer plates 102 may be detected. Further, a member which has a predetermined relationship with the separation plate 66 for detecting may be newly provided.

As described above, the present invention provides the optimum position of the suction-adhering apparatus at each printing plate precursor feeding process and allows efficient separation of the plates.

What is claimed is:

1. An apparatus for feeding printing plate precursors, the apparatus comprising:

a cassette which accommodates printing plate precursors in a stack, the cassette including a wall portion and a separation plate that engages with corners of the printing plate precursors for aiding to separate an uppermost printing plate precursor from underlying printing plate precursors;

a suction unit including a suction member which suction-adheres to an uppermost printing plate precursor accommodated in the cassette, the suction unit being supported so as to be movable toward and away from the cassette;

a driving device which moves the suction unit;

a plate detecting sensor provided in the suction unit, the plate detecting sensor being positioned within a predetermined distance of a printing plate precursor using a suction surface of the suction member as a reference so as to detect a position of the uppermost printing plate precursor when the suction unit moves close to the printing plate precursor;

a separation plate detecting sensor provided in the suction unit, the separation plate detecting sensor for detecting the separation plate or a member having a fixed relative position with respect to the separation plate before the plate detecting sensor detects the uppermost printing plate precursor; and a controlling device which controls the driving device on the basis of the detection by the plate detecting sensor and the separation plate detecting sensor to move the suction unit toward and away from the cassette while controlling timing of the suction member for removal of printing plate precursors.

2. The apparatus of claim 1, wherein the member which has a fixed relative position with respect to the separation plate is an edge of the wall portion of the cassette.

3. The apparatus of claim 1, in which the member which has a fixed relative position with respect to the separation plate is a bottom surface of the cassette.

4. The apparatus of claim 1, further comprising a detecting member which has a fixed relative position with respect to the separation plate.

5. A system for feeding printing plate precursors into an automatic exposure apparatus, the system comprising:

(a) a removably mounted cassette which receives and holds printing plate precursors in a stack prior to printing plate precursors being fed into the exposure apparatus, the cassette including a separation plate for facilitating separation of a printing plate precursor from the underlying stack;

(b) a suction frame movable upon application of driving force towards and away from the cassette, along a movement range, the suction frame including suction nozzles that move with the suction frame;

(c) a motor which when operated supplies driving force to the suction frame, moving the suction frame towards and away from the cassette;

(d) a reduced pressure source connected in fluid communication with the suction nozzles, the reduced pressure source being operable for applying reduced pressure to the suction nozzles;

(e) a separation plate sensor which indicates position of the suction frame and separation plate relative to one another at at least one location of the suction frame along the suction frame's range of movement;

(f) an approach sensor which indicates when the suction frame is approaching the stack; and (g) a controller connected in electronic communication to the motor, the reduced pressure source, and the sensors, and controls operation of the motor and the reduced pressure source based upon indications from the sensors by at least:

(i) moving the suction frame towards the cassette to where a printing plate precursor is adherable to the suction nozzles by applying reduced pressure to the suction nozzles from the reduced pressure source;

(ii) applying reduced pressure to the suction nozzles and suction adhering the printing plate precursor to the suction nozzles; and (iii) moving the suction frame away from the cassette to where the separation plate facilitates separation of the printing plate from the underlying stack based upon an indication from the separation plate sensor.

6. The system of claim 5, wherein said moving the suction frame towards the cassette continues for a preset amount of time after an indication is received from the approach sensor.

7. The system of claim 5, wherein the approach sensor comprises a retractable shaft projecting from the suction frame towards the cassette, and indicates said approaching when the shaft abuts the stack and retracts.

8. The system of claim 5, wherein interleaf material is provided between printing plate precursors in the stack, further comprising a discrimination sensor in electronic communication with the controller and which provides an indication to the controller whether the uppermost layer of the stack is a printing plate precursor or interleaf material.

9. The system of claim 5, wherein the motor is controlled by pulses communicated thereto from the controller, and the controller controls operation by noting the pulse number at which the separation plate sensor indicates relative position of the suction frame and separation plate relative to one another when moving the suction frame towards the cassette, and in said moving the suction frame away from the cassette, continues the movement away until the pulse number of the motor equals the noted pulse number.

10. A method for feeding printing plate precursors from a cassette holding the printing plate precursors in a stack, the method comprising the steps of:

determining an initial position of a movably mounted suction frame which suction adheres printing plate precursors to suction nozzles provided on the suction frame by application of reduced pressure to the suction nozzles;

moving the suction frame toward the cassette using a pulse-controlled motor which when operated moves the suction frame away and towards the cassette;

detecting a portion of the cassette with a first sensor;

detecting a surface of an uppermost printing plate precursor in the stack in the cassette with a second sensor;

reading a first drive controlling pulse number of the motor; and moving the suction frame further downward by a predetermined amount and stopping the frame at a position at which the suction nozzles adhere to the uppermost printing plate on the stack when reduced pressure is applied to the suction nozzles.

11. The method of claim 10, further comprising the steps of:

raising the suction frame after suction-adhering the uppermost printing plate precursor; and reading a second drive controlling pulse number of the motor.

12. The method of claim 11, further comprising the step of determining to continue raising the suction frame or ceasing to raise the suction frame by a comparison of the first drive controlling pulse number and the second drive controlling pulse number.

13. The method of claim 12, further comprising the step of retracting a shaft supporting the first sensor to retract the first sensor after the step of reading the first drive controlling pulse number of the motor.

14. The method of claim 13, wherein said portion of the cassette comprises a separation plate.

15. The method of claim 11, further comprising the step of retracting a shaft supporting the first sensor to retract the first sensor after the step of reading the first drive controlling pulse number of the motor.

16. The method of claim 15, wherein said portion of the cassette comprises a separation plate.

17. The method of claim 11, wherein said portion of the cassette comprises a separation plate.

18. The method of claim 10, further comprising the step of retracting a shaft supporting the first sensor to retract the first sensor after the step of reading the first drive controlling pulse number of the motor.

19. The method of claim 18, wherein said portion of the cassette comprises a separation plate.

20. The method of claim 10, wherein said portion of the cassette comprises a separation plate.

* * * * *